US005764143A

United States Patent [19]

Buccola

[11] Patent Number: 5,764,143

[45] Date of Patent: Jun. 9, 1998

[54] COMBINATION TEMPERATURE UNIT/ INTRUDER SENSOR UTILIZING COMMON COMPONENTS

[75] Inventor: Charles S. Buccola, Valley Stream, N.Y.

[73] Assignee: Napco Security Systems, Inc., Amityville, N.Y.

[21] Appl. No.: 865,460

[22] Filed: May 29, 1997

[51] Int. Cl.[6] ..... G08B 19/00

[52] U.S. Cl. ..... 340/521; 340/522; 340/541; 340/567; 340/584; 340/600; 340/578

[58] Field of Search ..... 340/521, 522, 340/567, 584, 541, 600, 517, 516, 577, 578

[56] References Cited

U.S. PATENT DOCUMENTS

| | | | |
|---|---|---|---|
| 3,613,064 | 10/1971 | Peterson et al. | 340/527 |
| 4,001,819 | 1/1977 | Wise | 340/521 |
| 4,195,234 | 3/1980 | Berman | 307/117 |
| 4,360,856 | 11/1982 | Witthaus | 361/170 |
| 4,533,904 | 8/1985 | Steinman, Jr. | 340/521 |
| 4,642,612 | 2/1987 | Crump | 340/541 |
| 4,775,853 | 10/1988 | Perez Borruate | 340/521 |
| 5,195,126 | 3/1993 | Carrier et al. | 379/45 |
| 5,302,941 | 4/1994 | Berube | 340/505 |
| 5,331,308 | 7/1994 | Buccola et al. | 340/522 |
| 5,420,567 | 5/1995 | Schwartz | 340/521 |
| 5,486,810 | 1/1996 | Schwartz | 340/521 |
| 5,578,988 | 11/1996 | Hoseit et al. | 340/522 |
| 5,629,676 | 5/1997 | Kartoun et al. | 340/567 |

OTHER PUBLICATIONS

King Alarm Product Brochure, p. 7, Circa. Spring 1997.

*Primary Examiner*—Jeffery A. Hofsass
*Assistant Examiner*—Benjamin C. Lee
*Attorney, Agent, or Firm*—John R. Mugno

[57] ABSTRACT

A combination temperature unit/intruder sensor is described wherein the thermistor used for adjusting the sensitivity of a passive infrared detector in a microprocessor of the unit is also used for the secondary purpose of indicating whether the ambient temperature of a protected zone falls outside a pre-selected temperature range. The detector, in addition to providing signals indicative of an intruder, can provide indications of possible freezing, thawing, or fire conditions. Both the intruder detection and temperature sensing capabilities are provided in a single, inexpensive housing.

20 Claims, 2 Drawing Sheets

COMBINATION TEMPERATURE UNIT/ INTRUDER SENSOR UTILIZING COMMON COMPONENTS

FIELD OF THE INVENTION

This invention is generally directed to a sensor capable of providing both a first signal indicative of an intruder in a protected zone and a second signal indicative of temperatures at the sensor location which are outside permissible predetermined ranges. More specifically, the sensor of the present invention provides the dual capabilities of temperature sensing and intrusion detection in a manner in which individual components are utilized for both functions thereby resulting in significant cost savings and ease in manufacturing.

BACKGROUND OF THE INVENTION

The alarm industry is replete with intrusion detectors which incorporate passive infrared (PIR) sensors. Sensors incorporating PIR technology can be used independently or in conjunction with a complimentary technology (such as microwave (MW) technology) to provide devices to sense the presence of an intruder in a protected zone. Such technology and devices are well-known and well-developed in the art.

In essence, PIR sensors separate a protected area into distinct and discrete zones. A detector senses variation of PIR energy in each zone and provides such information to a microprocessor which, in turn, utilizes calculations to establish thresholds of large enough variations which indicate the presence of an intruder. In fact, the software in the microprocessor normally would contain alternative subroutines wherein the one selected to be run would depend on the temperature in the protected zone. For instance, the detection of a human being in a 20° Fahrenheit room would not require the degree of sensitivity (or fine tuning of the PIR energy detected in sequential zones) that a detection of a human being in a 85° Fahrenheit room would require since the latter example reflects a protected zone having an ambient temperature much closer to the temperature of a detected human being thereby making it more difficult to sense the presence of the human being.

In order to determine which subroutine should be run by the microprocessor, a sensor incorporating PIR technology typically comprises a thermistor (or other temperature sensing means) which provides information to the microprocessor of the temperature at the unit which is allowed to estimate the temperature in the protected zone. Intrusion detection devices vary greatly in price depending on such factors as their range, the level of sophistication in detecting false alarms, their ability to provide tamper signals, and a host of other factors. However, each intrusion detection device would typically cost anywhere from $10–$100.

Although not as widely used as intrusion detection devices, alarm companies can also monitor unacceptable temperature ranges through the use of devices commonly referred to as "temperature units." An example in which the sensing of an unacceptably high temperature is important can be in a meat locker or other areas in which the maintaining of a cold temperature is required. Conversely, an example in which an unacceptably low temperature should be detected can be a vacation home in a cold climate wherein freezing temperatures could result in burst pipes.

Like intrusion detection devices, temperature units vary greatly in price depending upon their level of sophistication but generally will cost the user anywhere between $7–$60. This cost for a temperature unit is insignificant in comparison to the repair cost and inconvenience incurred by spoiled inventory, destroyed pipes (and the corresponding water damage cause thereby), etc.

It should be noted at this stage that a temperature unit can, in essence, be modified to detect fire. Such a modification is achieved by detecting the rate of temperature change over time, instead of detecting a specific temperature. In a fire situation, the rate of change in the sensed temperature will be high and the conclusion is made that this high rate of change is caused by a burgeoning fire.

In an effort to decrease manufacturing costs and provide multiple functions to consumers, the prior art does include combination units which contain in a single case the ability to detect more than one indica. For instance, Steinman, Jr. U.S. Pat. No. 4,533,904 provides a housing which includes both a smoke sensor and a line attached thereto which can be attached to an adjacent door or window such that the opening of the door or window increases tension on the line which removes a locking pin and releases a plunger to strike a tester button thereby actuating an alarm. This "physical" type of burglar alarm, of course, is extremely unsophisticated compared to electronic burglar alarms available today.

Schwarz U.S. Pat. No. 5,486,810 provides a more sophisticated combination fire/burglar alarm device. In essence, the device described in the prior art patent includes separate and distinct circuitry for sensing intruders and fire. However, costs savings are achieved by the requirement that only a single housing is necessary. The aforementioned U.S. Pat. No. 5,486,810 has many shortcomings. For instance, the circuitry is complex and expensive to manufacture since many components would need to be placed on a single printed circuit board or two circuit boards would be required. In short, this reference simply "squeezes" two devices in a single unit. Furthermore and importantly, the integrity of this system is insufficient since the degradation (or catastrophic failure) of the incorporated active infrared sensor negates the effectiveness of both the intrusion detection function and the fire detection function.

It is, therefore, a primary object of the present invention to provide a new and improved combination temperature unit/intruder sensor.

It is another object of the present invention to provide a new and improved combination temperature unit/intruder sensor which is no more expensive to produce than prior art devices capable of sensing only intruders.

It is yet a further object of the present invention to provide a new and improved combination temperature unit/intruder sensor having temperature settings which can be selected by the user.

It is yet another object of the present invention to provide a new and improved combination temperature unit/intruder sensor which maintains the integrity of one function even if there is a loss of integrity in the other function.

Further objects and advantages of the present invention will become apparent as the following description proceeds.

SUMMARY OF THE INVENTION

Briefly stated and in accordance with the preferred embodiment of the present invention, an integral combination detector for sensing both the presence of an intruder in a protected zone and whether a temperature level is outside a pre-selected range is provided which comprises a PIR sensing means for generating a detection signal responsive to motion in the protected zone, a temperature sensing means for providing a temperature signal reflective of the ambient temperature level, and processing means coupled to both the infrared sensing means and the temperature sensing means for providing a first output signal indicative of the presence of an intruder and a second output signal indicative of a temperature level outside the pre-selected range. The determination of whether to issue the first and second output signals are made separately but are determined from information received from the sole temperature sensing means. The temperature unit portion of the combination detector can be used to indicate an unacceptably low ambient temperature (wherein the risk is typically freezing), an unacceptably high ambient temperature (wherein the risk is typically spoilage), or an unacceptably high rate of change in detected temperature (which can be deemed indicative of a fire condition).

BRIEF DESCRIPTION OF THE DRAWINGS

While the specification concludes with claims particularly pointing out and distinctly claiming the subject matter regarded as the invention herein, it is believed that the present invention will be more readily understood upon consideration of the description, taken in conjunction with the accompanying drawings, wherein:

DESCRIPTION OF THE PREFERRED EMBODIMENT

Figure 1:
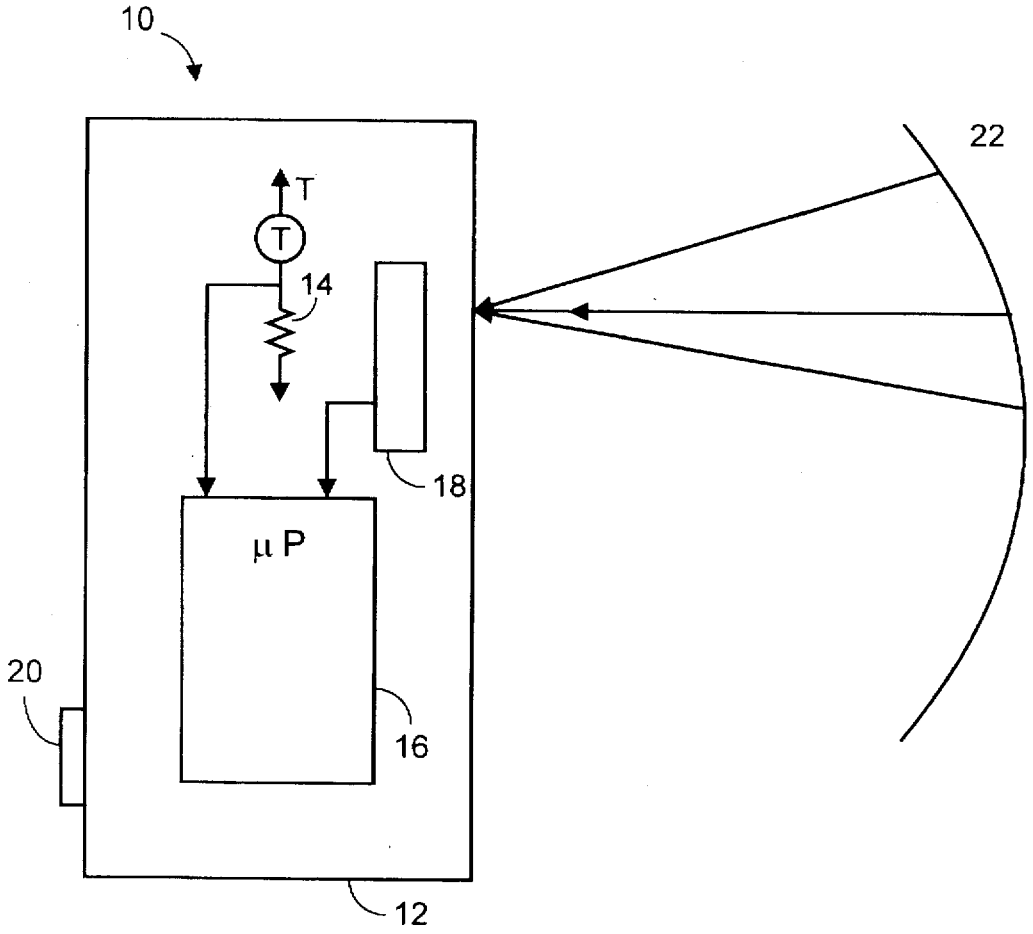
FIG. 1 is a schematic block diagram of the combination temperature unit/intruder sensor in accordance with the present invention.

Referring to FIG. 1, a combination temperature unit/intruder sensor is generally designated 10. Combination temperature unit/intruder sensor 10 in enclosed in a case 12. Illustrated schematically in case 12 is a thermistor 14, a microprocessor 16, and a PIR sensor 18. On the outside of case 12 is a user selectable switch 20. User selectable switch 20 permits a user to select acceptable ranges for the unit as will be described in further detail below.

Temperature unit/intruder sensor 10 is capable of monitoring a protected zone 22 to determine whether an intruder is present. The specific circuitry used in intrusion detection devices incorporating PIR technology are extremely well-known. In essence, protected zone 22 is separated into discreet zones and variations of the detected PIR energy in such zones are sensed to create an electrical signal. As shown in FIG. 1, PIR sensor 18 measures these variations and provides information to microprocessor 16, after signals sensed by PIR sensor 18 are shaped, filtered and converted into digital form. The filtering and analog-to-digital conversion of signals used in PIR devices are well known.

Thermistor 14 provides information regarding the ambient temperature of protected zone 22 to help establish thresholds for the variations in sensed PIR energy which should result in an issued alarm. If thermistor 14 detects a temperature close to the temperature of a human being, the sensitivity of temperature unit/intruder sensor 10 will have to be greater than if thermistor 14 senses a temperature significantly different than that of a detected intruder. Studies have shown that a clothed human being is typically sensed at a temperature approximately between 85°–90° Fahrenheit.

The temperature reading actually provided by thermistor 14 to microprocessor 16 is typically several degrees different than the ambient temperature due to the insulation of thermistor 14 provided by case 12. Thus, microprocessor 16 can be provided a compensation adjustment to have the temperature provided by thermistor 14 be more accurate of ambient room temperature. This compensation adjustment would raise the temperature several degrees in very cold environments and lower the temperature several degrees in very hot environments. As will be shown below, the temperature provided to microprocessor 16 by thermistor 14 is used to both help select the threshold on when an alarm should issue based on readings from PIR sensor 18 and to provide information to allow unit 10 to act as a temperature unit.

Figure 2:
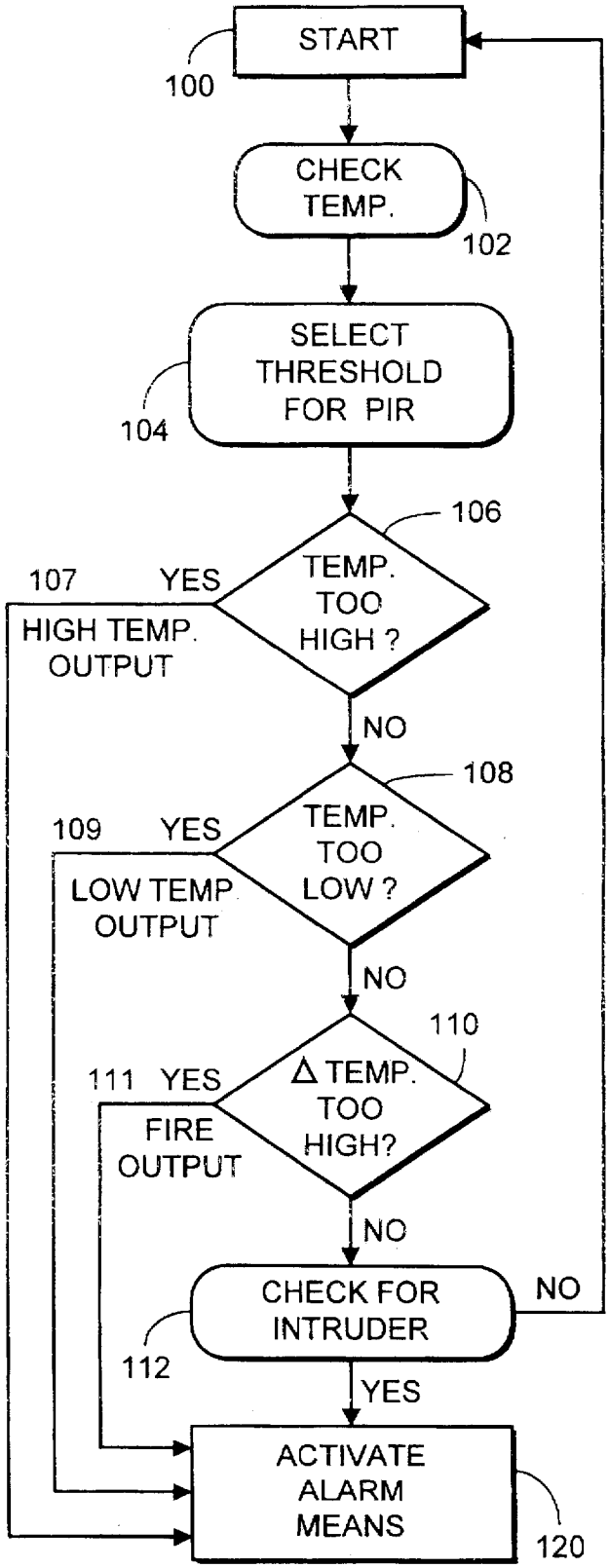
FIG. 2 is a flow diagram of the program to detect unacceptable temperature levels and a presence of an intruder in accordance with the present invention.

Turning now to FIG. 2, a simplified flow diagram of the program run in temperature unit/intruder sensor 10 is shown. Box 100 reflects the initiation of the program in microprocessor 16. The next step, indicated by box 102, is a check of ambient temperature as provided by thermistor 14. Based on the determination of the ambient temperature, a threshold for when to issue an alarm based on sensing by PIR sensor 18 is established (box 104). In essence, a sensitivity level for PIR sensor 18 is established based on the temperature provided by thermistor 14. In operation, this adjustment of sensitivity may take the form of the selection of one of an alternate number of subprograms for determining whether an intruder is present in protected zone 22. Box 106 is representative of a comparison between the temperature provided by thermistor 14 (as indicated by box 102) and a preselected maximum temperature. The preselected maximum temperature might be programmed into microprocessor 16 or be user selectable by user selectable switch 20. In either case, any temperature over the preselected maximum value will be deemed unacceptable and will result in a high temperature output along line 107. The signal along line 107 can be used to activate an alarm means (as indicated by box 120). The setting of a maximum allowable temperature is useful in environments whereby a high temperature could result in the spoilage of produce, meat, and the like.

Box 108 is representative of a comparison between a preselected minimum allowable temperature and the temperature provided to microprocessor 16 by thermistor 14. If the ambient temperature, as provided by thermistor 14, is below the allowable minimum temperature, a low temperature output is provided along line 109. Again, line 109 has been shown to activate an alarm means. The setting of a minimum allowable temperature is useful in environments whereby a low temperature could result in frozen pipes.

Box 110 is representative of using the prevent invention to determine whether a fire condition exists in protected zone 22. Namely, the ambient temperature (as provided by box 102) is periodically checked and a rate of change is determined. If the rate of change is above the rate which typically indicates a fire (or smoke) condition, a fire output signal will be provided along line 111. Line 111 is again used to activate an alarm means as indicated by box 120. A high rate of change for temperature in an ambient environment is indicative of fire due to the fact that at outset a fire results in significant changes in temperature which cannot be caused (or are highly unlikely to be caused) by any other phenomena.

Box 112 is representative of the numerous software programs used to determine whether information provided by a PIR sensor should result in the issuance of an alarm. The sensitivity utilized by box 112 is, however, dependent on the temperature provided by thermistor 14. If the software determines an intruder is present, the alarm means are activated; if no intruder is detected, the program re-starts.

It will be apparent from the foregoing description that the present invention provides a combination temperature unit/intruder sensor wherein a single thermistor is used for both adjusting the sensitivity of a passive infrared detector and for indicating whether the ambient temperature of a protected zone falls outside a preselected temperature range. This dual-purpose use of a thermistor provides an inexpensive detector which can provide signals indicative of an intruder, a freezing condition, a thawing condition, or a fire condition.

While there has been shown and described what is presently considered to be the preferred embodiment of this invention, it will be obvious to those skilled in the art that various changes and modifications may be made without departing from the broader aspects of this invention. For instance, while the preferred embodiment has been described as providing a means for indicating each of a (i) thawing condition, (ii) a freezing condition, and (iii) a fire condition, the device can be set to provide an indication of only one, or any combination, of these conditions. The inclusion or exclusion of different functions can be achieved by placing respective enable/disable decision boxes between boxes 106, 108 and 110 and alarm activation box 120. Furthermore, while the output signals along lines 107, 109, and 111 have been shown to activate an alarm means, these signals instead can be used to illuminate a trouble indicator such as a light emitting diode (LED). Finally, although the intrusion detection sub-system of the present invention has been described as a PIR-only device, it can be used in connection with dual technology devices which also incorporate a complimentary technology such as a MW sensor.

It is, therefore, aimed in the appended claims to cover all such changes and modifications as fall within the true scope and spirit of the invention.

I claim:

1. A detector for sensing both the presence of an intruder in a protected zone and whether a temperature level is outside a pre-selected range wherein said detector is contained in an integral casing and comprises:

a) infrared sensing means for generating a detection signal responsive to motion in said protected zone;

b) temperature sensing means for providing a temperature signal reflective of said temperature level; and c) processing means coupled to both said infrared sensing means and said temperature sensing means for providing:

(i) a first output signal indicative of the presence of an intruder whereby generation of said first output signal is dependent on both said detection signal and said temperature signal; and (ii) a second output signal indicative of said temperature level being above or below said pre-selected range whereby generation of said second output signal is dependent on said temperature signal.

2. The detector of claim 1 wherein said temperature sensing means is a thermistor.

3. The detector of claim 1 wherein said pre-selected range is established by setting a maximum permissible temperature.

4. The detector of claim 1 wherein said pre-selected range is established by setting a minimum permissible temperature.

5. The detector of claim 1 wherein said pre-selected range is established by setting both a maximum permissible temperature and a minimum permissible temperature.

6. The detector of claim 1 further comprising:

alarm means actuated by one of said first output signal and said second output signal.

7. The detector of claim 1 wherein said pre-selected range is user adjustable.

8. A combination in an integral casing for monitoring protected zone comprising:

a) a motion detector comprising:

(i) infrared sensing means for generating a detection signal responsive to motion in said protected zone;

(ii) temperature sensing means for providing a temperature level at said detector;

(iii) first processing means coupled to both said infrared sensing means and temperature sensing means for providing a first output signal indicative of the presence of an intruder in said protected zone wherein said first processing means comprises a plurality of subroutines reflective of various sensitivity levels for issuing said first output signal whereby one of said plurality of subroutines selected is dependent upon said temperature level; and b) a temperature detector comprising:

(i) second processor means coupled to said temperature sensing means for providing a second output signal indicative of a pre-established and unacceptable temperature condition in said protected zone;

whereby said pre-established and unacceptable temperature condition includes under-temperature and over-temperature detections.

9. The combination detector of claim 8 wherein said temperature condition is a temperature level above a pre-selected maximum temperature threshold.

10. The combination detector of claim 8 wherein said temperature condition is a temperature level below a pre-selected minimum temperature threshold.

11. The combination detector of claim 8 wherein said temperature condition is a temperature rate of change above a pre-selected maximum temperature rate of change threshold whereby said threshold established as being indicative of a fire condition.

12. The detector of claim 8 wherein said temperature sensing means is a thermistor.

13. The detector of claim 8 further comprising:

alarm means activated by one of said first output signal and said second output signal.

14. A detector in a unitary housing for issuing a first output signal when an intruder is in a protected zone and a second output signal when ambient temperature in said protected zone is detected to be below or above a predetermined range comprising:

intruder sensing means for providing an intruder signal;

temperature sensing means in said housing for providing a temperature signal; and processing means coupled to said temperature sensing means and intruder sensing means for independently generating said first and second output signal whereby the determination to issue said first and second output signals is responsive to at least said temperature signal, respectively.

15. The detector of claim 14 wherein said temperature sensing means is a thermistor.

16. The detector of claim 14 wherein said predetermined range is established by setting a maximum permissible temperature.

17. The detector of claim 14 wherein said predetermined range is established by setting a minimum permissible temperature.

18. The detector of claim 14 wherein said predetermined range is established by setting both a maximum permissible temperature and a minimum permissible temperature.

19. The detector of claim 14 further comprising:

alarm means activated by one of said first output signal and said second output signal.

20. The detector of claim 14 wherein said predetermined range is user selected.

* * * * *